United States Patent [19]

Wang et al.

[11] 4,118,224

[45] Oct. 3, 1978

[54] NICKEL-CHROMIUM HEATING ELEMENT ALLOY HAVING IMPROVED OPERATING LIFE

[75] Inventors: Teh Po Wang, North Caldwell; Carrol Dean Starr, Whippany, both of N.J.

[73] Assignee: Wilbur B. Driver Company, Newark, N.J.

[21] Appl. No.: 747,777

[22] Filed: Dec. 6, 1976

[51] Int. Cl.[2] ..... C22C 19/05

[52] U.S. Cl. ..... 75/171

[58] Field of Search ..... 75/171, 170; 148/32, 148/32.5

[56] References Cited

U.S. PATENT DOCUMENTS 3,627,511 12/1971 Taylor et al. ..... 75/171

*Primary Examiner*—R. Dean

*Attorney, Agent, or Firm*—John C. Fox

[57] ABSTRACT

The addition of about 0.33 weight percent of hafnium to a nickel-chromium heating element alloy having a nominal composition of 20 weight percent chromium, 1.4 weight percent silicon, balance essentially nickel, results in an improved operating life of the alloy.

5 Claims, No Drawings

NICKEL-CHROMIUM HEATING ELEMENT ALLOY HAVING IMPROVED OPERATING LIFE

BACKGROUND OF THE INVENTION

This invention relates to heating element alloys, and more particularly relates to nickel-chromium heating element alloys having improved operating life.

The so-called "80/20" nickel-chromium alloy in wire or strip form is used extensively as the heating element in resistance heating applications. An accepted means for evaluating the performance of a heating element is by ASTM life test B76-65. In this test, a constant temperature of 2175° F on a 0.0253 inch diameter wire, maintained by resistance heating, is applied at "2minute on-2 minute off" intervals until failure by burnout occurs. This life test may be significantly accelerated by raising the wire being tested to a temperature of 2200° F, while keeping all other test conditions the same. In addition, carrying out the test as a constant temperature test, by changing the power supplied to the sample during the test, is a more severe test than a constant voltage test or constant current test which have been used in the past. In a constant voltage test, the input voltage is maintained constant throughout the test. Because of high temperature oxidation, the effective diameter of the wire decreases, causing an increase in resistance. This in turn cause a decrease in electrical current flowing through the wire, because of the constant voltage. The net result is a decrease in power supplied to the wire, and a significant decrease in test temperature. Therefore, the test temperature toward the end of a constant voltage life test could be 100° F lower than the initial temperature. On this basis, the constant temperature test is much more severe than the constant voltage test and results from these tests should not be directly compared without an understanding of the boundary condition of these two tests. See, e.g., Methods of Testing Nickel Chromium Alloys Used for Heating Elements, C. D. Starr, ASTM Proceedings, Vol. 64, 1964.

The average life to failure at 2200° F of a recent sample of 48 different production heat of a commercial 80/20 nickel-chromium alloy produced by W. B. Driver Co. and having a trade name of Tophet A is 197 hours.

The beneficial effect of zirconium upon operating life of the 80/20 nickel-chromium alloy heating elements is known. For example, in U.S. Pat. No. 2,019,686, Lohr teaches the addition of calcium and zirconium to such an alloy to increase its operating life. In later patents, Lohr teaches the addition of aluminum with calcium and zirconium to nickel-chromium-iron alloys. Subsequent Lohr patents teach the addition of calcium, aluminum and rare earths to improve life of nickel-chromium-iron alloys over lives obtainable for such alloys containing calcium, aluminum and zirconium. (See: U.S. Pat. Nos. 2,581,420; 2,687,954; 2,687,956; Re. 24,242, and Re.24,244).

Zirconium has also been added to nickel-chromium-iron alloys of the superalloy type (high temperature resistant and corrosion resistant). (See, for example, U.S. Pat. Nos. 3,516,826 and 3,865,581).

However, the addition of zirconium to nickel-chromium alloys for the purpose of extending life of heating elements of these alloys has several attendant disadvantages, including a detrimental effect upon workability of the alloys at addition levels approaching 0.2 weight percent, loss of zirconium during charging into the alloy melt, and variations of such charge losses from melt to melt. All of these factors have led to difficulty and expense in producing heating element alloys of predictably long operating lives by the addition of zirconium.

It is felt that significant increases in the operating life of an 80/20 nickel-chromium alloy without attendant processing difficulties would enable longer life of heating elements incorporating these alloys, or alternatively enable smaller size heating elememts without a corresponding reduction in operating life, and that accordingly such increases in operating life would be an advancement in the art.

SUMMARY OF THE INVENTION

In accordance with the invention, it has been discovered that the addition of from about 0.1 to 0.75 weight percent of hafnium to a nickel-chromium heating element alloy having a nominal base composition of 20 weight percent chromium, 1.4 weight percent silicon, trace amounts of Ca, Al and B, (up to 0.5 weight percent total) balance essentially nickel, significantly increases operating life of the alloy as a heating element over alloys which do not contain hafnium. For example, the average operating life at 2200° F of the nominal base composition alloy plus about 0.17 to 0.58 weight percent hafnium is about 250 hours, more than 100 hours greater than the average life of the nominal base composition alloy containing neither hafnium nor zirconium.

The alloys of the invention would thus find use in resistance heating applications where longer operating lives or smaller sizes of heating elements are desired.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

The base alloy to which hafnium may be added to achieve the advantages of the invention is conventionally referred to as an 80/20 nickel-chromium heating element alloy. One such commercially available alloy is Tophet A, containing about 20 weight percent chromium, 1.4 weight percent silicon, 0.05 to 0.15 weight percent zirconium, balance essentially nickel, with trace amounts (up to 0.5 weight percent total) of conventional deoxidizers). As defined herein, such 80/20 alloys include any base alloy composition falling within the following ranges: 18 to 22 weight percent chromium, 1.0 to 1.6 weight percent silicon, balance essentially nickel. In addition, up to one weight percent each of cobalt, iron and copper as impurities may be tolerated, and one or more of Ca, C, Mn, Zr, Mg, Al, B and Ti may be intentionally added in amounts of up to 0.10 weight percent each as deoxidizers.

EXAMPLE 1

A series of eight experimental 6 pound heats containing 20 weight percent chromium, 1.4 weight percent silicon, from 0 to 0.58 weight percent hafnium, 0 to 0.25 weight percent zirconium, and identical amounts of Ca, Al and B as deoxidizers, balance nickel were hot rolled to ⅜ inch diameter rods and thence drawn to 0.0253 inch diameter wire for life testing. Life testing was carried out generally in accordance with ASTM life test B76-65. The samples were heated to 2200° F, instead of 2175° F, in order to accelerate testing, by resistance heating. The temperature was maintained constant throughout the test by changing the power supplied to the sample. Results are shown below in Table 1 as average time to failure in hours.

TABLE I

Operating Life of .0253" dia. Wire Drawn From Hot Rolled Rods of 80 NI/20 CR Based Alloys as a Function of Hafnium Content

| Melt No. | % HF | % Zr | Time to Burnout at 2200° F, Hrs. AV* |
|---|---|---|---|
| 1 | 0 | 0 | 152 |
| 2 | .17 | 0 | 252 |
| 3 | .33 | 0 | 254 |
| 4 | .32 | 0 | 254 |
| 5 | .32 | .25 | 254 |
| 6 | .36 | 0 | 239 |
| 7 | .50 | 0 | 251 |
| 8 | .58 | 0 | 270 |

*Average of two samples.

As shown in the Table, the addition of hafnium improves operating life to burnout of the 80/20 nickel-chromium alloy. Average life to failure of alloys containing from about 0.17 to 0.58 weight percent hafnium is about 250 hours, about 100 hours longer than that of the same alloy without hafnium or zirconium.

The beneficial effect of zirconium on operating life of these alloys is known. However, the addition of about 0.25 weight percent zirconium to an 80/20 nickel-chromium alloy with 0.33 weight percent hafnium did not further improve operating life.

EXAMPLE 11

Small samples of 0.0179 inch diameter, 0.020 inch diameter and 0.0253 inch diameter wire were drawn from hot rolled rods of 80/20 nickel-chromium alloys with 0.33 weight percent hafnium and Tophet A alloy containing from 0.05 to 0.15 weight percent zirconium for life testing. The results of life testing at 2200° F are shown in Table 11.

TABLE II

Comparison of Life to Burnout at 2200F of 80 NI/20 CR With .33 Hf vs Tophet A as a Function of Wire Diameter

| Wire Dia., in | Tophet A | Life to Burnout at 2200F 80/20 + .33 Hf | % Increase in Life vs Tophet A |
|---|---|---|---|
| .0179 | 137 | 162 | 19 |
| .020 | 146 | 180 | 23 |
| .0253 | 195 | 250 | 25 |

As shown in Table 11, the life test result of this particular 0.0253 inch diameter Tophet A sample is 195 hours, only 2 hours below the 197 hours average obtained from 48 production heats of Tophet A, referred to above. This life of 195–197 hours of Tophet A is much higher than the 152 hours of the 80/20 Ni/Cr base alloy without Hf as listed in Table 1. The reason for this is the beneficial effect of the 0.05 to 0.15% Zr in Tophet A, which Zr is absent from the 80/20 Ni/Cr base alloy of Table 1. The life of the hafnium-containing alloy, in all cases, was about 20 percent greater than that of the Tophet A alloy at the same size. In addition, the life of the 0.0179 inch diameter wire with hafnium (162 hours) was greater than the life of Tophet A 0.020 inch diameter wire (146 hours). Thus, one could substitute a smaller diameter wire containing hafnium for a wire of an alloy containing no hafnium, and yet realize an improvement in total operating life.

In summary, it appears that an increase in operating life of from about 20-25 percent over that of Tophet A could be achieved by the use of hafnium additions in the amounts specified to the 80/20 nickel-chromium based alloy.

While there has been shown and described what are at present considered the preferred embodiments of the invention, it will be obvious to those skilled in the art that various changes and modifications may be made therein without departing from the scope of the invention as defined by the appended claims.

What is claimed is:

1. A nickel-chromium heating element alloy consisting essentially of a base composition in weight percent within the range of: 18 to 22 percent chromium, 1.0 to 1.6 weight percent silicon, balance essentially nickel, characterized in that the alloy contains from about 0.1 to 0.75 weight percent hafnium, whereby the operating life of the alloy as a resistance heating element is improved.

2. The alloy of claim 1 wherein hafnium is present in the amount from about 0.1 to 0.5 weight percent.

3. The alloy of claim 1 additionally containing up to 0.10 weight percent each of one or more elements selected from the group of deoxidizers consisting of Ca, C, Mm, Zr, Mg, Al, B and Ti.

4. The alloy of claim 1 consisting essentially of in weight percent:

Cr: 20
Si: 1.4
Hf: 0.25, up to 0.5 total of Ca, Al and B, balance Ni.

5. A resistance heating element consisting essentially of the alloy of claim 1.

* * * * *